United States Patent [19]

Sanders

[11] Patent Number: 4,863,136

[45] Date of Patent: Sep. 5, 1989

[54] PICTURE HANGER AND FASTENER

[76] Inventor: Merwyn H. Sanders, 1138 E. Hyde Park Blvd., Chicago, Ill. 60615

[21] Appl. No.: 165,129

[22] Filed: Mar. 7, 1988

[51] Int. Cl.[4] ..... A47F 7/14

[52] U.S. Cl. ..... 248/490; 248/201; 248/74.5

[58] Field of Search ..... 248/488, 489, 494, 74.5, 248/201, 490, 491, 492, 493, 229, 498; 24/563; 40/152.1, 156

[56] References Cited

U.S. PATENT DOCUMENTS

| | | | |
|---|---|---|---|
| 3,188,028 | 6/1965 | Waller | 248/498 X |
| 3,541,714 | 11/1970 | Bruck, Jr. | 40/156 |
| 4,027,413 | 6/1977 | Moede | 40/156 |
| 4,282,668 | 8/1981 | Jolkovski | 248/488 X |
| 4,368,585 | 1/1983 | Meltzer et al. | 40/152.1 |

FOREIGN PATENT DOCUMENTS

| | | | |
|---|---|---|---|
| 908870 | 4/1946 | France | 40/152.1 |
| 276285 | 7/1930 | Italy | 248/262 |
| 635846 | 4/1950 | United Kingdom | 248/490 |

*Primary Examiner*—Ramon S. Britts
*Assistant Examiner*—Karen J. Chotkowski

[57] ABSTRACT

A picture hanger or fastener device for securing or mounting framed pictures upon a wall that includes a readily deformable body, having a distal end with a centrally located opening therein for the attachment of said hanger/fastener to the wall, and having a proximal end which is readily bendable or deformable about said picture frame or a structural element of a picture frame.

12 Claims, 1 Drawing Sheet

FIG. 1
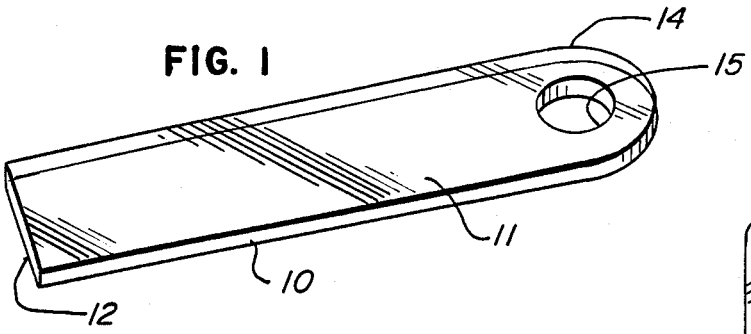
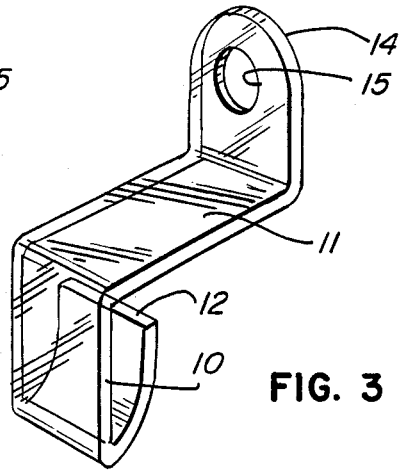
FIG. 3
FIG. 2
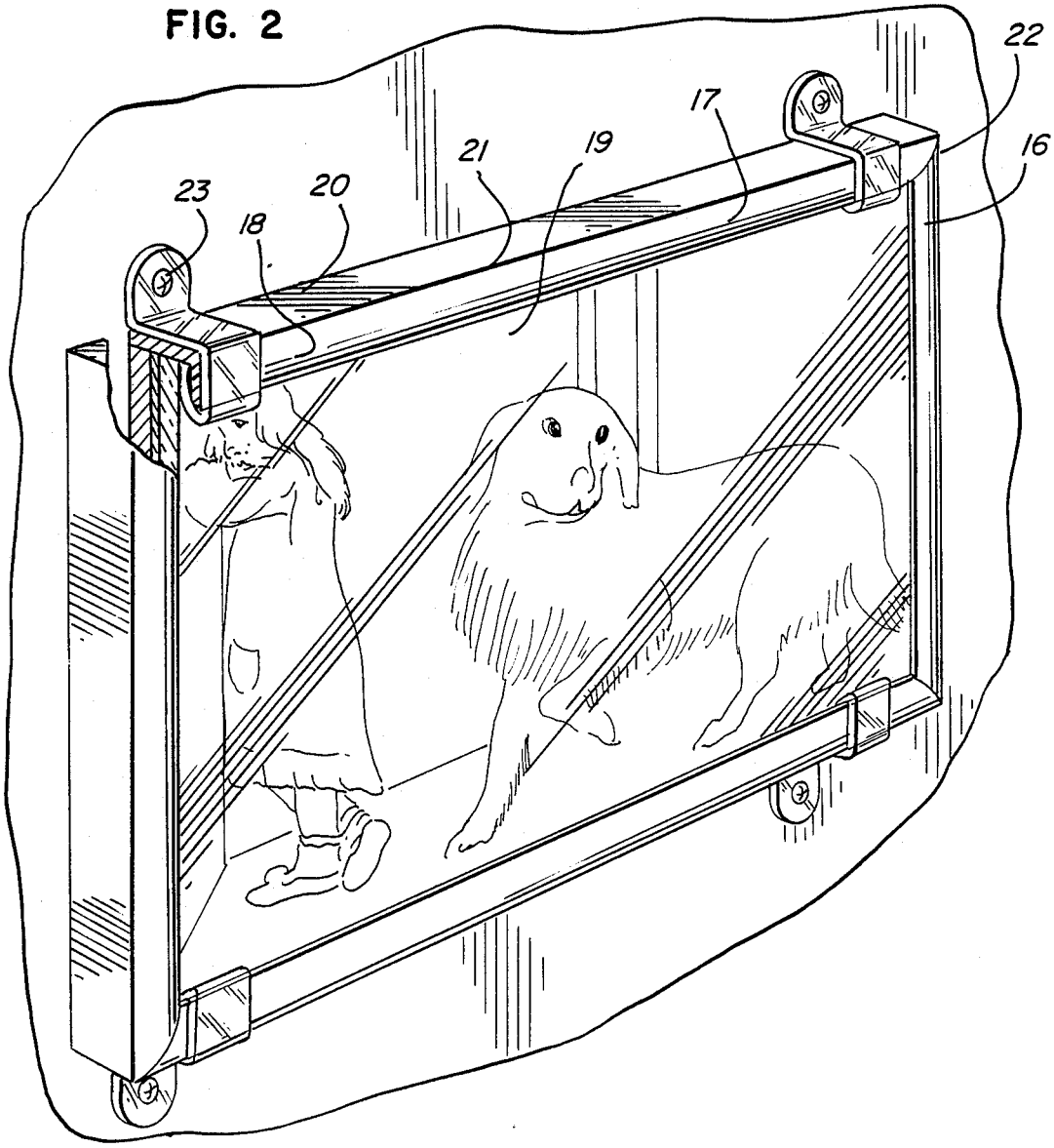

PICTURE HANGER AND FASTENER

BACKGROUND OF THE INVENTION

This invention relates to a means for hanging pictures whereby they may thereafter be securely fastened in place on a wall. More particularly, the present invention relates to a deformable means bendable about the frame of a picture or the like for hanging same and securing it in place on a wall.

DESCRIPTION OF THE PRIOR ART

The prior art is replete with frame attachments or clips which are utilized for the mounting and hanging of pictures, portraits and the like. For example, U.S. Pat. No. 4,282,668 discloses a mounting system and method wherein a spring-biased, easily located, frame clip mounting system is taught. Therein, a U-shaped frame clip adapted to be slipped over a sandwich-like structure having an unprepared, piercable backing material is revealed. The system also includes a plow-type anchoring assembly operatively connected to the frame clip through the provision of a spring biasing means. The anchor assembly includes a base having a front portion and teeth protruding from the base and angled downwardly towards the front portion. The spring biasing means is connected between the front portion of the base of the anchor assembly and the frame clip so as to cause self-tighting when the teeth of the base of the anchor assembly are pressed into the pierceable backing material.

The prior art also discloses deformable clips for portrait frames and the like. For example, U.S. Pat. No. 4,509,278 which teaches a clip of the the type constituted by a metal strip that deforms elastically, and which is shaped so as to wrap around one edge of a frame. The first terminal part, at the opposite end of the first terminal part of the clip, is placed in a slot made in the outer surfact of the back part of the frame. The strip, in its non-operative position, is defined, in between the two terminal parts, by two substantially flat sections which form, one with the other, an angle of less than 90, these sections constituting a covering section which is placed adjacent to one of the edges of the portrait frame and a rear section which is placed adjacent to the back part of the frame. The rear section is provided at one extremity with an integrally formed pressure tongue oblique thereto and with a pair of strengthening the ribs disposed respectively on the opposite sides of the tongue.

Other prior art, of which applicant is presently aware, is disclosed in the following: U.S. Pat. Nos. 1,763,024, 2,593,195, 2,661,560, 2,698,470, 2,807,110, 2,885,166, 3,003,272, 3,349,443, 3,541,714, 3,981,091, 4,103,446, 4,217,710, 4,391,053.

While the picture framing, hanging, and/or fastening clips of the prior art are suitable for their intended purposes, they are however, burdened with certain attendant drawbacks. Firstly, the clips of the prior art are of complex design and configuration, and thereby present the probability of high manufacturing costs and, invariably a high consumer purchase price. Secondly, the means disclosed in the prior art references consist of various component parts which must be approximately assembled prior to or during attachment and placement, or such means must be purchased by the consumer as part of a system which includes mounting or framing components.

Still further, while provision is made in prior art devices for the framing and hanging of portraits, pictures and the like, no means have been provided therewith for securing the frames in place once framing and hanging have been accomplished. This glaring deficiency becomes blatantly obvious with wall-mounted pictures or the like, particularly in areas of heavy traffic in commercial establishments, or in residences where playful children are prone to knock wall mountings out of place or from the wall altogether, thereby causing the need for constant readjustment, re-positioning, or frequent replacement of frame components.

In view of the aforementioned drawbacks of prior art disclosures, it is an object of the present invention to provide a novel picture hanger and fastener which is of simple construction and design.

Another object of the present invention is to provide a picture hanger and fastener which is inexpensive to manufacture, and which, thereby may be offered to the consuming public at low cost.

A further object of the present invention is to provide a picture hanger and fastener which may be easily mounted to a picture frame and thereafter securely fastened in place on a wall such that it may not be inadvertently dislodged out of position, mistakenly knocked from the wall by playing children or the like, or easily removed therefrom by burglars or thieves.

These and other additional objects of the present invention will be best understood from a reading of the following detailed description taken in conjunction with the accompanying drawing figures which form part of the specification.

BRIEF DESCRIPTION OF THE DRAWINGS

FIG. 1 is a top view of the picture hanger and fastener of the present invention shown prior to attachment to a picture frame.

FIG. 2 is a front perspective view of the present invention shown adapted to a picture frame and attached to a supporting wall.

FIG. 3 is a perspective view of the present invention shown in its deformed state after application to a picture frame.

DETAILED DESCRIPTION OF THE INVENTION

Referring now to the drawing figures, and particularly to FIG. 1, there is illustratively shown the picture hanger/fastener 10 of the present invention which includes a flat, elongate body 11 having a proximal end 12 and a distal end 14. As can be seen, proximal end 12 is characterized by right-angled edges. The edges of distal end 14 are generally arcuate in configuration. While the rationale for such a design may not be readily apparent to the reader at this point, a further reading of this specification will indubitably clarify the justification and purposes for such a construction. Distal end 14 further includes centrally-located aperture 15 which extends through the body 11 of the picture hanger/fastener 10 from its top flat surface through its bottom flat surface.

Preferrably, hanger/fastener 10 is manufactured of a thin, metallic or plastic material which is readily deformable. It is contemplated that hanger/fastener 10 may be stamped from a sheet material such as 0.035 mill finish aluminum or the like since such material provides a hanger/fastener which may be re-deformed to its original flat shape if the user thereof inadvertently deforms same in such a manner that it does not appropriately and snuggly fit about the frame of the picture being hung or secured in place.

Referring now to FIG. 2, in adapting hanger/fastener 10 about the frame 16 of a picture, it first becomes necessary to position hanger/fastener 10 near that portion of the front surface 17 of a picture where the bottom front edge 18 of the frame 16 comes into contact with glass 19 normally utilized to cover or protect the picture housed by the frame 16. Proximal end 12 of hanger/fastener 10 is then inserted for an approximate distance into that area between the protective glass 19 and the back of the front edge 18 of the frame 16. Preferrably, hanger/fastener 10, or the proximal end 12 thereof, finally abutts against the bottom surface of the horizontally disposed, top structural member 20 of frame 16. Once appropriately inserted, hanger/fastener 10 is deformed upwardly and backwardly. It is then deformed upwardly and forwardly until hanger/fastener 10 abutts against the front edge 21 of frame top structural member 20. Hanger/ fastener 10 is then deformed outwardly and forwardly along the top surface of frame top structural member 20 such that its bottom flat surface rests against and parallel to the top surface of structural member 20. Upon reaching the back edge 22 of structural member 20, the distal end 14 of hanger/fastener 10 which defines aperture 15 is deformed vertically upwardly and backwardly such that its vertical disposition extends parallel to and upwardly from the rear surface of frame 16. An appropriate attachment means 23 is then inserted through aperture 15 of hanger/fastener 10 for attachment of frame 16 to an appropriate vertical surface.

Once appropriately deformed about the frame 16 of a picture, Hanger/fastener 10 assumes a configuration similar to that configuration detailed in FIG. 3. As can be seen, proximal end 12 and the lower middle portion of hanger/fastener 10 provide a generally U-shaped slot into which the bottom front, vertically disposed edge 18 of frame 16 fits, while the distal end 14 housing aperture 15 and the upper middle portion of hanger/fastener 10 provide an L-shaped configuration which extends horizontally along the top surface of frame top structural member 20 and vertically upwardly along the attachment surface.

While it is conceivable that a hanger/fastener attached centrally to the top of a picture frame will securely and appropriately fasten a picture in place on a vertical surface, it is preferred that at least two top and one bottom hanger/fastener be attached to each picture frame. Alternatively, a plurality of hanger/fasteners may be adapted about the top and bottom frame structural members for attachment to a vertical surface, or a hanger/fastener may be attached to each of the top and bottom structural members of the frame.

Referring again to FIG. 1, and as previously alluded to hereinabove, the rounded edges of the distal end 14 of hanger/fastener 10 are so configured as to prevent any possible scraping or scarring of the vertical surface to which hanger/fastener 10 is attached. It is perceived that right-angled edges on such end would possibly dig into the vertical attachment surface and cause undesirable defacement thereof.

The right-angled edges of the proximal end 12 of hanger/fastener 10 are seen as providing an anti-slip quality thereto as any twisting of hanger/fastener 10 would facilitate its inadvertent removal from the back side of the bottom front edge of the picture frame. The presence of such edges, however, precludes such inadvertent removal should bending or twisting occur.

The fact that the hanger/fastener described herein is manufactured of a readily bendable or deformable material, such as aluminum or plastic, does not detract from its intrinsic ability to secure and maintain-in place pictures and picture frames of substantial weight. It would not be practical, however, to attempt hanging a picture of great weight by utilizing hanger/fasteners only on the top part of the frame. Such an act would place an inordinate and unanticipated amount of stress on the unit. In such cases it is suggested that units be placed at the bottom of such picture frames as well so as to provide a shelf-like support therefor.

It is also to be understood that while a particular embodiment of the invention has been herein illustrated and described, it is not intended to limit the invention to such disclosure.

Still further, the phraseology and terminology herein employed are for purposes of description and not of limitation, since the scope of the invention is denoted by the appended claims.

What is claimed is:

1. A picture hanger assembly for hanging pictures and the like, and for securing same in place on a wall comprising a picture hanger element and frame;

the picture hanger element comprises an elongate, deformable body having a proximal end and a distal end;

said distal end includes an upper middle portion being L-shaped and having an opening therein for the insertion of a fastener for the attachment of said hanger element to an appropriate surface such as a wall;

said proximal end includes a straight portion extending perpendicularly from the upper middle portion at an end opposite the opening and a curved portion extending from the straight portion in a direction towards the distal end;

the frame comprises a front edge and an opposing back edge adjacent a top structural member having an opposing vertically disposed edge;

wherein the upper middle portion is disposed along the top structural edge and a support surface, the straight portion of the proximal end is disposed along the front edge and the curved portion of the proximal end is disposed around the vertically disposed edge.

2. The picture hanger element as described in claim 1 wherein said proximal end further includes right angled edges.

3. The picture hanger element as described in claim 1 wherein the edge of said distal end is round.

4. The picture hanger element described in claim 1 wherein said opening is centrally located within said distal end.

5. The picture hanger element as described in claim 1 wherein said elongate, deformable body is made of a metallic material such as 0.035 mill finished aluminum.

6. The picture hanger element as described in claim 1 wherein said elongate, deformable body is made of a plastic material.

* * * * *